United States Patent [19]

Meyer et al.

[11] 4,095,068

[45] June 13, 1978

[54] STATIONARY-CONTACT-AND VOLTAGE-SHIELD ASSEMBLY FOR A GAS-PUFFER-TYPE CIRCUIT-INTERRUPTER

[75] Inventors: Jeffry R. Meyer, Penn Hills Township, Allegheny County; Robert L. Hess, North Versailles, both of Pa.

[73] Assignee: Westinghouse Electric Corp., Pittsburgh, Pa.

[21] Appl. No.: 685,465

[22] Filed: May 12, 1976

[51] Int. Cl.[2] ..... H01H 33/82; H01H 9/30

[52] U.S. Cl. ..... 200/144 AP; 200/148 A; 200/82 B

[58] Field of Search ..... 200/286, 287, 289, 148 A, 200/148 R, 148 B, 82 B, 163, 144 AP, 150 G; 361/333, 335

[56] References Cited

U.S. PATENT DOCUMENTS

| | | | |
|---|---|---|---|
| 2,757,261 | 7/1956 | Lingal | 200/148 B |
| 3,045,086 | 7/1962 | Leeds | 200/148 B |
| 3,291,948 | 12/1966 | Telford | 200/148 A |
| 3,358,105 | 12/1967 | Barker | 200/148 R |
| 3,889,084 | 6/1975 | Kucharski | 200/148 B |
| 3,891,893 | 6/1975 | Thaler | 200/148 A |
| 3,941,962 | 3/1976 | Thaler | 200/148 A |

*Primary Examiner*—Gene Z. Rubinson
*Assistant Examiner*—William L. Feeney
*Attorney, Agent, or Firm*—W. R. Crout

[57] ABSTRACT

An improved, multi-function, stationary-contact-and-voltage-shield structure is provided for a high-voltage gas-puffer-type circuit-interrupter, in which the surrounding metallic shield provides a smooth, low-gradient voltage shape, collecting and cooling the dispersed hot arced gases, generated during the interrupting operation at the arc, by the provision of selectively-located venting cooling port holes provided in the metallic shield structure and also in the stationary contact structure.

The arrangement of the enveloped stationary contact and surrounding main stationary contact fingers, together with the outer, encompassing vented metallic shield arrangement is such as to provide an improved highly-efficient single-pressure puffer-type high-voltage circuit-interrupter.

12 Claims, 5 Drawing Figures

STATIONARY-CONTACT-AND VOLTAGE-SHIELD ASSEMBLY FOR A GAS-PUFFER-TYPE CIRCUIT-INTERRUPTER

CROSS-REFERENCE TO RELATED APPLICATIONS

Reference may be made to U.S. patent application filed Dec. 31, 1975, Ser. No. 645,753 by T. E. Alverson et al., entitled "Circuit Breaker", and U.S. patent application filed Dec. 31, 1975, Ser. No. 645,867 by Russell N. Yeckley et al., entitled "Circuit Breaker", and U.S. patent application filed Mar. 21, 1975, Ser. No. 560,461, now U.S. Pat. No. 4,075,447, issued Feb. 21, 1978 to Joseph R. Rostron, entitled "Double-Puffer-Type Compressed-Gas Circuit-Interrupter Constructions", and U.S. Pat. No. 3,987,262 issued Oct. 19, 1976 to Joseph R. Rostron. Other applications, which may be referred to, are U.S. patent application filed May 12, 1975, Ser. No. 576,820, now U.S. Pat. No. 3,987,262, issued Oct. 19, 1976 to Joseph Rostron; U.S. patent application filed Aug. 7, 1975, Ser. No. 602,705, now U.S. Pat. No. 4,044,211, issued Aug. 23, 1977 to Cromer et al.; U.S. patent application filed Sept. 25, 1975, Ser. No. 616,703 by Rostron et al.; U.S. patent application filed Mar. 11, 1976, Ser. No. 665,823 by Cromer et al.; U.S. patent application filed Sept. 21, 1976, Ser. No. 725,313 by Cromer et al.; all of said patent applications being assigned to the assignee of the instant patent application.

Reference may also be made to U.S. patent application filed Dec. 31, 1975, Ser. No. 645,752, by Cromer et al., entitled "Improved Double-Flow Puffer-Type Single-Pressure Compressed-Gas Circuit-Interrupter", and also assigned to the assignee of the instant patent application.

BACKGROUND OF THE INVENTION

In recent years there has come about a demand for a reduced-size substation, and this demand, on the part of public utilities, has been net by gas-insulated substation equipment, such as set forth in U.S. Pat. Nos. 3,378,731, Whitehead; 3,348,001, Upton et al.; 3,801,768, Meyer; 3,794,797, Spindle et al.; 3,356,798, McKinnon; 3,610,858, Gruber et al.; 3,599,041, Boersma et al; and 3,562,460, Koener.

The foregoing equipment significantly reduces the space required by the high-voltage side of substations rated, for example, 115 through 345 K.V. The space reduction is accomplished by replacing the open bus and air-type terminal-bushings with gas-insulated bus, filled, for example, with a highly-insulating gas, such as sulfur-hexafluoride ($SF_6$) gas, at a pressure say, for example, 45 p.s.i.g., and thereby permitting the location of electrical equipment very close together. This gas-insulated substation equipment has many advantages, among which are:

1. Significant reduction in space requirements both in land area and overall height.
2. Added system reliability by eliminating the possibility of phase-to-phase faults, lightning strokes within the system, or contamination of insulators.
3. Reduced maintenance because the closed system is isolated from its environment.
4. Added personnel safety because all live parts are covered by grounded shields.
5. The gas-insulated modular approach has the additional advantage, because it provides the utility user with lower installation costs, when compared with conventional, or other types of power-transmission systems.

BRIEF SUMMARY OF THE INVENTION

In accordance with the principles of the present invention, an improved stationary-contact structure and an encompassing, surrounding, outer metallic low-gradient shield construction is provided having a multi-function effect, in not only providing a low-voltage gradient between the separated contacts in the open-circuit position of the interrupter, but also collecting and cooling the dispersed arcing gases generated during an arcing interrupting operation, the metallic shield preferably having one or more suitably-located cooling venting ports for this cooling and exhausting function.

Not only does the improved metallic voltage shield provide a desirable low-gradient electrostatic field condition, but, additionally, the metallic shield provides a capacitor support point, a gas disperser for collecting and cooling the hot arc gases, and, finally, the enclosed stationary contact structure provides a suitable load-current contact point for the high-voltage puffer-type circuit-interrupter.

The several elements are so arranged and so mounted as to be capable of ready attachment to a suitable mounting support plate, when desired, so that the said mounting support plate may be fixedly secured to an interconnecting line-lead, such as a terminal-bushing, for example, or a gas-pressurized transmission-line, when gas-insulated transmission-line equipment is desired to be connected.

The forward extending end of the metallic voltage shield is curved preferably inwardly at its lower end to provide a relatively-larger-diameter, curved, leading projecting end-extremity to lower the electrostatic field, and to reduce the possibility of the main, slotted, stationary contact fingers undesirably increasing the electrostatic field stress.

The main stationary contact fingers are of a generally cylindrical configuration having rearwardly-located contact venting ports to collect the inwardly-directed hot arcing gases, and then to cause reversal of their direction of flow to suitably-provided, cooling, venting ports provided in the side walls of the aforesaid metallic shield.

DESCRIPTION OF THE PREFERRED EMBODIMENT

Figure 1:
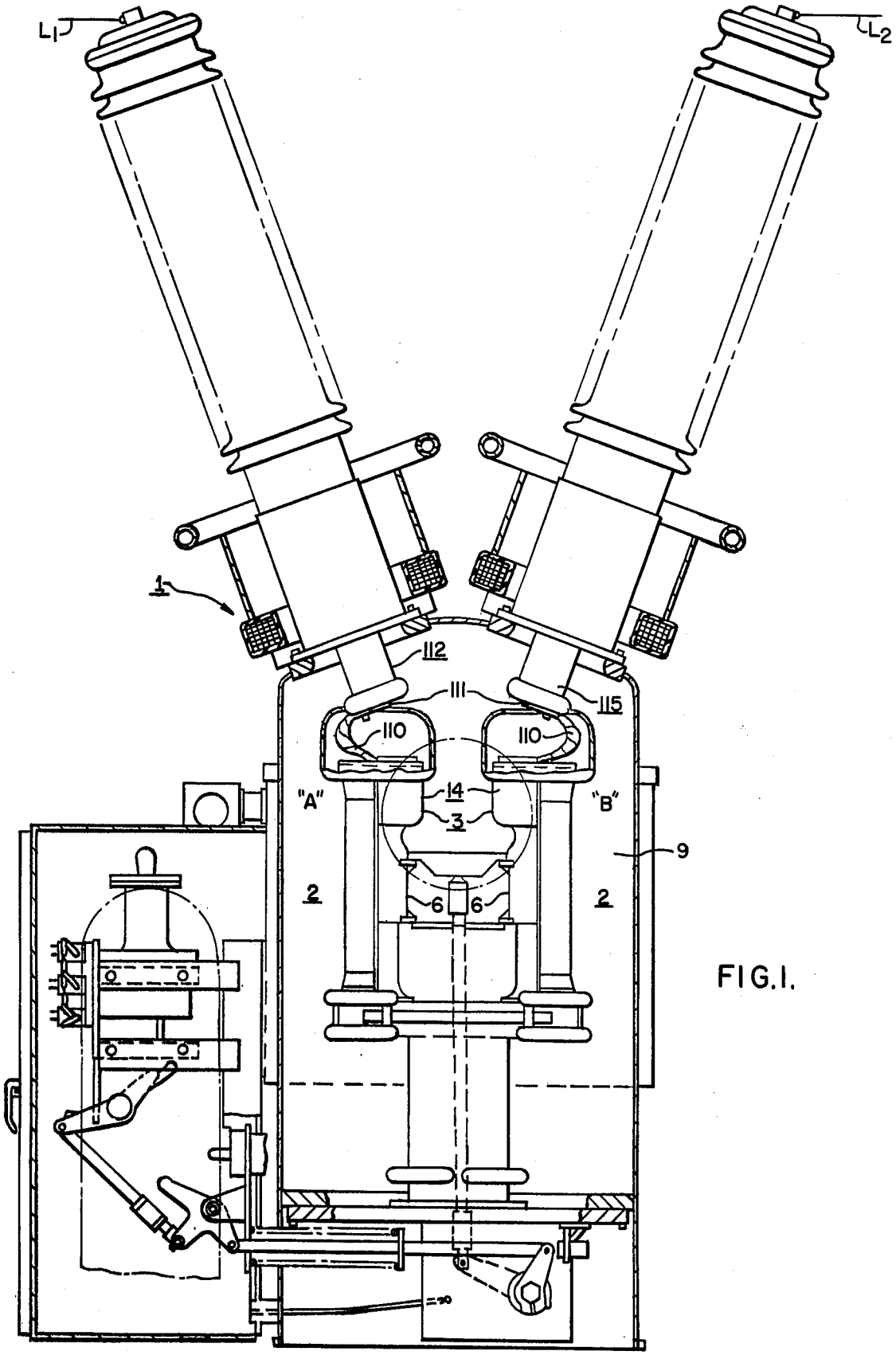
FIG. 1 is a vertical sectional view taken through a tank-type, single-pressure, double-break puffer circuit-interrupter illustrating an application of the present invention, the contact structure being illustrated in the closed-circuit position.

Referring to the drawings, and more particularly to FIG. 1 thereof, the reference numeral 1 generally designates a single-pressure, gas-type circuit-interrupter of the gas-puffer variety, which includes a pair of conjointly-acting arc-extinguishing puffer-units 2 electrically connected in series, and simultaneously actuated in a manner somewhat similar to that set forth in U.S. patent application filed Mar. 21, 1975, Ser. No. 560,421, by Joseph Rostron, and assigned to the assignee of the instant patent application. Also, reference may be made to U.S. patent application filed May 12, 1976, Ser. No. 685,466 by Jeffery R. Meyer et al.

As illustrated in FIG. 1, the relatively-stationary contact structure 3 cooperates with a relatively-movable contact structure 5, the movable contact structure 5 generally comprising an outer moving cylinder 6 movable over a relatively-fixed piston structure 7 of the type set forth, generally, in U.S. patent application filed Dec. 31, 1975, Ser. No. 645,752, by Charles F. Cromer et al., and assigned to the assignee of the instant patent application.

As will be apparent, downward opening movement of the movble contact structure 5, including the movable outer-disposed moving operating cylinder 6 over the relatively-stationary piston structure 7, generates a source of compressed gas within the intervening compression chamber 8, (FIG. 2) and ejects the gas 9 through the movable insulating nozzle orifice structure 10, and into the established arc 11, which is established between the centrally-disposed, rod-shaped stationary arcing contact 12 and the rod-shaped movable arcing contact, as indicated by the reference numeral 13.

Figure 2:
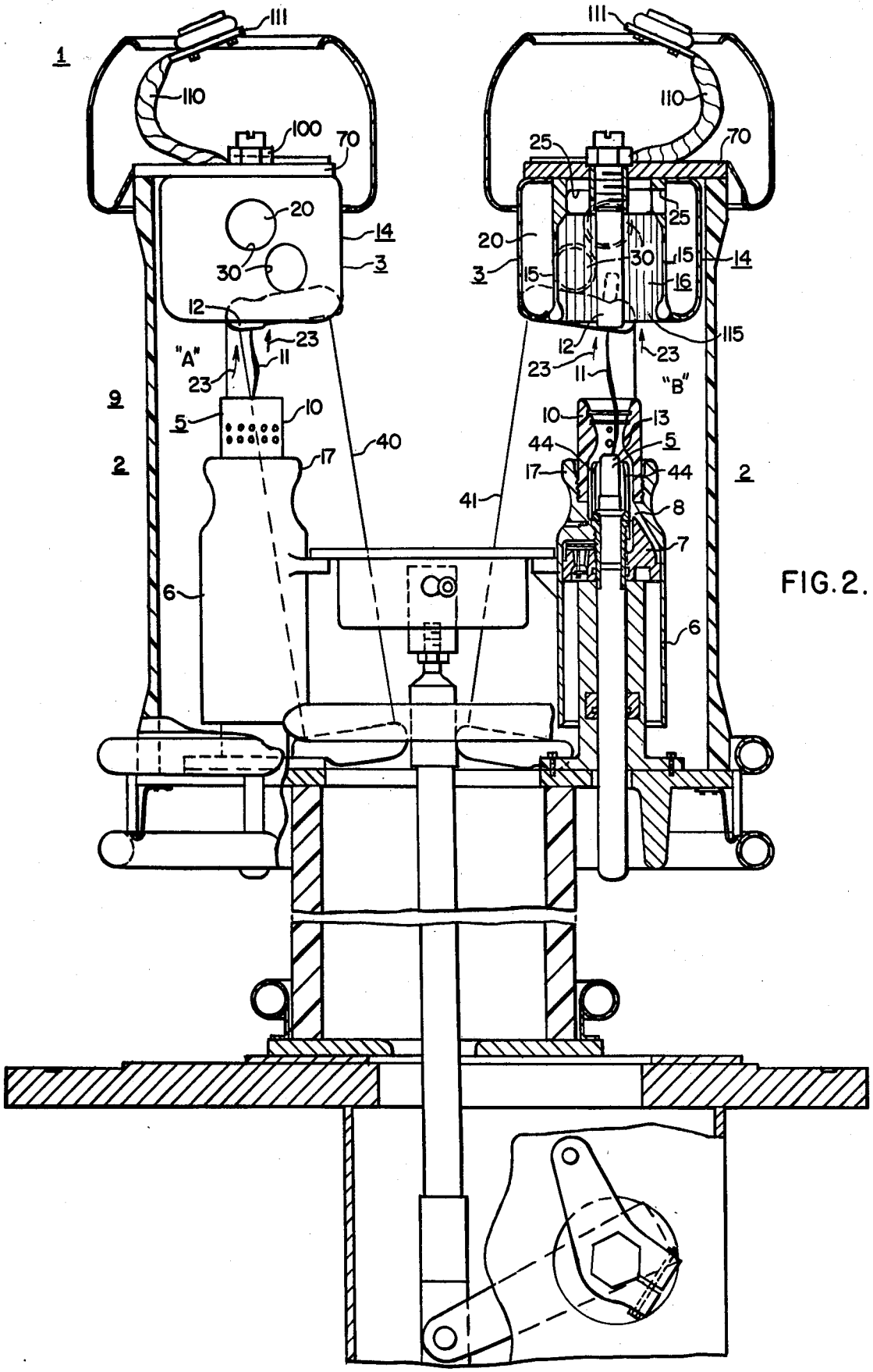
FIG. 2 is a vertical sectional view taken through a two-break, gas-puffer-type circuit-interrupter, the contact structure being illustrated in the fully-open-circuit position, and incorporating principles of the present invention.
Figure 3:
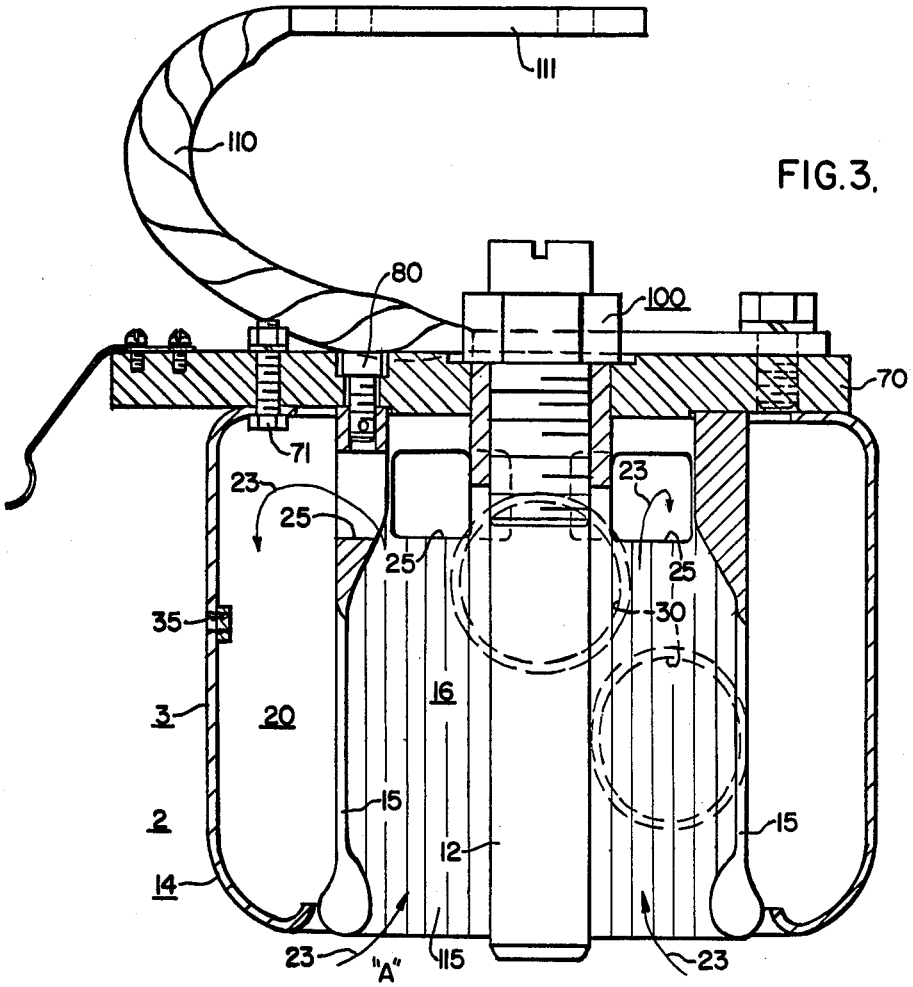
FIG. 3 is a somewhat-enlarged, vertical-sectional view of the relatively-stationary contact-and-shield arrangement, illustrating the curved configuration thereof, the contact ports and the shield-venting ports, again the contact structure being illustrated in the fully-open-circuit position, and the direction of gas flow being diagrammatically indicated by the arrows.

The upwardly-directed flow of hot gas causing extinction of the established arc 11, is collected within the metallic shield structure 14, more clearly illustrated in FIG. 3. The cluster of main slotted stationary contact fingers 15, engaging the outer side of the movable main contact 17, constitutes, generally, a receiving chamber 16 for the hot arcing gases, which are ejected thereinto, as indicated by the arrows 23 in FIG. 2. It will also be noted that the hot arcing gases, moving upwardly within the first collecting chamber 16, provided by the cluster of main stationary contact fingers 15, exhausts through the rearwardly-disposed contact vent-ports 25, and then caused to reverse their flow into laterally-disposed cooling venting ports 30 provided on the side walls of the metallic electrostatic shield 14. This reverse gas flow cools the hot arc gases by causing their intimate contact with the relatively-cool side walls of the metallic shield 14 and the cool gas therein.

In addition, the metallic electrostatic shield 14 provides a capacitor-mounting point, as designated by the reference numeral 35 (FIG. 3), which fixes the location and support of the two capacitor tubes 40, 41, as more clearly illustrated in FIG. 2.

As well known by those skilled in the art, such capacitors 40, 41 divide the total line voltage between the two breaks "A" and "B" during the opening operation, insuring thereby that each break will interrupt its fair share of the imposed total line voltage.

During the opening operation, the main stationary contact fingers 15 separate first from the annular movable main contact 17, causing thereby the secondary movable arcing contact fingers 44 to then separate from the rod-shaped stationary arcing contact 12, with the last point of contact separation occurring at the relatively-movable arcing horn 13 from the tubular stationary arcing contact 12. The established arc is drawn between these last points of contact separation, and is indicated by the reference numeral 11 in FIG. 2.

Meanwhile, the downward opening movement of the movable operating cylinder 6 over the relatively-stationary piston structure 7 has insured a compression of gas therebetween, which compressed gas is ejected upwardly through the insulating nozzle 10, against the established arc 11, causing its rapid extinction, and finally exhausting into the first collecting chamber 16, as shown more clearly in FIG. 2. This upwardly-directed gas flow is collected and cooled by the reverse gas flow and cooling engagement with the metallic shield 14 into the second collecting chamber 20, as set forth above.

Figure 5:
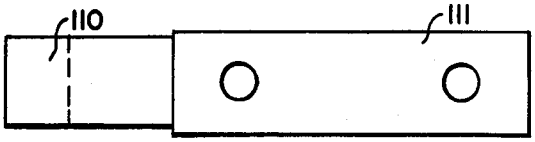
Figure 4:
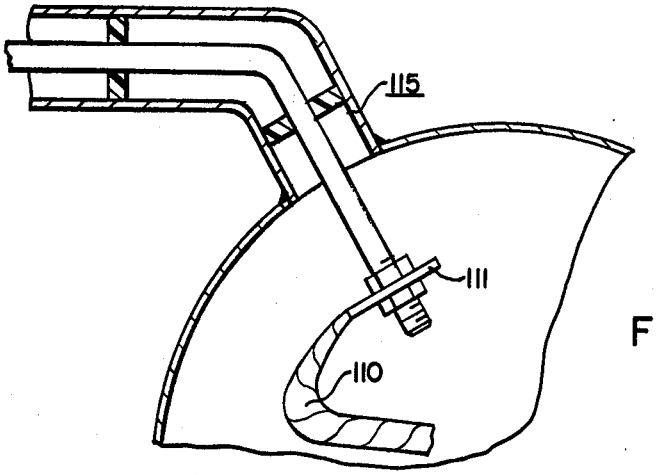
FIG. 4 illustrates fragmentarily a modified type of line connection for the stationary contact structure in connection with a gas-insulated transmission-line; and, FIG. 5 is a plan view of the flexible strap connection for the stationary contact structure.

It will be noted that all of the component parts of the relatively-stationary contact-and-shield arrangement 3 are preferably supported from a single metallic mounting support-plate 70. Thus, mounting bolts 71 are employed to affix the shield 14 to the lower side of the metallic mounting plate 70. Additionally, the cluster of main stationary contact fingers 15 are secured by mounting screws 80 to the mounting support-plate 70. Finally, the rod-shaped stationary contact 12 is secured by a suitable bolt and an adjustable nut arrangement 100 to the mounting support-plate 70, the latter being electrically connected by a flexible conductor 110 having a terminal-strap connection 111 (FIG. 5). The terminal-strap 111 may either be connected to the lower end of a suitable terminal-bushing 112, or, where desired, for certain applications, the flexible lead 110 and annular mounting strap 111 may, as shown in FIG. 4, be secured to suitable gas-insulated transmission equipment 115 of the type set forth in United States patent application filed by Willie B. Freeman et al. on Dec. 31, 1975 Ser. No. 645,867, entitled "Circuit Breaker", and assigned to the assignee of the instant patent application.

From the aforesaid description, it will be apparent that there has been provided an improved stationary-contact and shield arrangement 3 for a puffer-type of circuit-interrupter 1, which provides a smooth, low-gradient voltage shape, or configuration, which metallic shield structure 14 provides, additionally, a mounting point 35 for line-capacitors 40, 41, and moreover collects, cools and disperses the hot arc gases heated by contact with the interrupting arc 11. Finally, the disclosed contact structure 3 provides large main contact fingers 15 for continuous-current conduction with relatively-low heating.

Other important points of the instant invention include:

1. The large opening 115 (FIG. 3) at the end of the annularly-arranged contact fingers 15 tends to collect hot gases from the interrupter unit 2. Ports 25 provided in the stationary main contact 15 direct and swirl the gas 9 into a cavity 20 between the outer shield 14 and the contact fingers 15, where the gas 9 is cooled and expelled through ports 30 (FIG. 2) in the outer metallic shield 14, directing the cooled gas 9 into low-electrical-field gas volumes within the circuit-breaker 1.
2. Line capacitors 40, 41 can mount onto the outer metallic shield 14 at tapped holes 35 provided therein.

3. The main contacts 15, 17 provide a high-conductance path to carry the continuous relatively-heavy load current $L_1$–$L_2$ through the circuit-breaker 1.

All components preferably mount to a single mounting plate 70, which can then be attached to the breaker terminal bushing 112, or to an insulation support which is connected to the circuit-breaker housing.

Although there have been illustrated and described specific structures, the same were illustrated merely for the purpose of illustration, and it is well recognized that changes and modifications may be obvious to those skilled in the art, without departing from the spirit and scope of the invention.

We claim: relatively-stationary

1. Gas-type circuit-interrupter equipment including separable contact means to establish an arc, said separable contact means including a relatively-stationary contact and a cooperable movable contact, means defining a source of gas under pressure, means directing a flow of compressed gas from said source to the established arc to effect the extinction thereof, a generally-cylindrically-shaped metallic electrostatic shield exposed to the surrounding ambient and encompassing the relatively-stationary contact and ensuring a low-gradient electrostatic field at its forward end facing the movable contact and located between the said separated contact in the fully-open-circuit position of the gas-type circuit-interrupter, and said openly-exposed metallic electrostatic shield defining an exhaust-gas collecting chamber in open pace for receiving at its forward end the hot exhaust arced gases emanating from the arcing region during the arcing period of the said gas-type circuit-interrupter.

2. The combination according to claim 1, wherein the openly-exposed metallic shield is provided with one or more cooling venting port openings in the side walls thereof freely leading to the surrounding ambient.

3. The combination according to claim 1, wherein the relatively-stationary contact includes an encompassing stationary annular cluster of relatively-stationary main contact fingers and a centrally-disposed relatively-stationary arcing contact enveloped and shielded thereby.

4. The combination according to claim 1, wherein a metallic support-plate is provided to which the component arts of the relatively-stationary contact and electrostatic shield are fixedly secured.

5. The combination according to claim 3, wherein the leading edge of the relatively-stationary main contact fingers are in generally the same plane as the leading end surface of the metallic electrostatic shield.

6. The combination according to claim 1, wherein the gas-type circuit-interrupter is provided with a shunting capacitor tube, and the metallic electrostatic shield is provided with a capacitor-mounting support on its side vertical wall.

7. The combination according to claim 4, wherein a flexible terminal-lead connector (110) is fixedly secured to said metallic support-plate and provides a line connection to the relatively-stationary contact.

8. The combination according to claim 7, wherein a terminal-strap (111) is fixedly secured to one end of the flexible line-connector.

9. Gas-type circuit-interrupter equipment including separable contact means to establish an arc, said separable contact means including a relatively-stationary contact making engagement with its forward end with a cooperable movable contact, means defining a source of gas under pressure, means directing a flow of compressed gas from said high-pressure source to the established arc to effect the extinction thereof, a generally-cylindrically-shaped metallic electrostatic shield encompassing the relatively-stationary contact and ensuring a low-gradient electrostatic field at its forward end facing the movable contact and disposed between the said separated contacts in the fully-open-circuit position of the gas-type circuit-interrupter, said metallic electrostatic shield defining an exhaust-gas collecting chamber for receiving at its forward end the hot exhaust arced gases emanating from the arcing region during the arcing period of the said gas-type circuit-interrupter, said relatively-stationary contact also including a stationary annular cluster of relatively-stationary main contact fingers and a separately-disposed relatively-stationay arcing contact, said cluster of relatively-stationary main contact fingers being provided with rearwardly-disposed-venting ports located away from said movable contact for conducting the hot arcing gases into the outer-disposed annular exhaust-gas collecting-chamber defined by said metallic electrostatic shield.

10. The combination according to claim 9, wherein the electrostatic-shield vent-port openings are disposed in planes disposed forwardly of an imaginary plane in which said rearwardly-disposed venting ports of the cluster of relatively-stationary main contact fingers are located.

11. Gas-type circuit-interrupter equipment including separable contact means to establish an arc, said separable contact means including a relatively-stationary contact and a cooperable movable contact, means defining a source of gas under pressure, means directing a flow of compressed gas from said source to the established arc to effect the extinction thereof, a generally-cylindrically-shaped metallic electrostatic shield encompassing the relatively-stationary contact and ensuring a low-gradient electrostatic field at its forward end facing the movable contact and disposed between the said separated contacts in the fully-open-circuit position of the gas-type circuit-interrupter, said metallic electrostatic shield defining an exhaust-gas collecting chamber for receiving at its forward end the hot exhaust arced gases emanating from the arcing region during the arcing period of the said gas-type circuit-interrupter, and the metallic electrostatic shield having an inwardly-curved lower extremity constituting a reverse bend, the end extremity of which is disposed rearwardly of the forward end of said metallic electrostatic shield.

12. Gas-type circuit-interrupter equipment including separable contact means to establish an arc, said separable contact means including a relatively-stationary contact and a cooperable movable contact, means defining a source of gas under pressure, means directing a flow of compressed gas from said source to the established arc to effect the extinction thereof, a generally-cylindrically-shaped metallic electrostatic shield encompassing the relatively-stationary contact and ensuring a low-gradient electrostic field at its forward end facing the movable contact and disposed between the said separated contacts in the fully-open-circuit position of the gas-type circuit-interrupter, said metallic electrostatic shield defining an exhaust-gas collecting chamber for receiving at its forward end the hot exhaust arced gases emanating from the arcing region during the arcing period of the said gas-type circuit-interrupter, the relatively-stationary contact including a stationary annular cluster of relatively-stationary main contact fingers and a centrally-disposed relatively-stationary arcing contact, the lower end of the metallic electrostatic shield being curved inwardly constituting a reverse-bend structure, and the inwardly-disposed edge of the metallic shield being in very close proximity to the contacting portions of the cluster of relatively-stationary main contact fingers.

* * * * *